US008063581B2

(12) United States Patent
Van Der Wal et al.

(10) Patent No.: US 8,063,581 B2
(45) Date of Patent: Nov. 22, 2011

(54) DRIVE CIRCUIT FOR DRIVING A LOAD WITH PULSED CURRENT

(75) Inventors: Roelf Van Der Wal, Oss (NL); Zadok Vitalis Socrates Kroeze, Oss (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 529 days.

(21) Appl. No.: 12/303,376

(22) PCT Filed: Jun. 20, 2007

(86) PCT No.: PCT/IB2007/052387

§ 371 (c)(1), (2), (4) Date: Dec. 4, 2008

(87) PCT Pub. No.: WO2007/148298

PCT Pub. Date: Dec. 27, 2007

(65) Prior Publication Data

US 2009/0195184 A1 Aug. 6, 2009

(30) Foreign Application Priority Data

Jun. 22, 2006 (EP) ..... 06115869

(51) Int. Cl.
*G05F 37/02* (2006.01)
*H05B 37/00* (2006.01)

(52) U.S. Cl. ..... 315/291; 315/307

(58) Field of Classification Search ..... 315/291, 315/307, 224, 209 R, 312, 76, 77, 78, 244, 315/246

See application file for complete search history.

(56) References Cited

U.S. PATENT DOCUMENTS

| | | | | |
|---|---|---|---|---|
| 4,849,683 | A | 7/1989 | Flolid | |
| 6,150,771 | A * | 11/2000 | Perry | 315/291 |
| 6,586,890 | B2 * | 7/2003 | Min et al. | 315/224 |
| 6,943,504 | B1 * | 9/2005 | York | 315/224 |
| 2003/0227265 | A1 | 12/2003 | Biebl | |
| 2005/0185113 | A1 | 8/2005 | Weindorf et al. | |

FOREIGN PATENT DOCUMENTS

| | | | |
|---|---|---|---|
| EP | 1006506 | A1 | 6/2000 |
| EP | 1229764 | A2 | 8/2002 |
| EP | 1278401 | A1 | 1/2003 |
| WO | 03017729 | A1 | 2/2003 |
| WO | 03049505 | A1 | 6/2003 |

* cited by examiner

*Primary Examiner* — Douglas W Owens
*Assistant Examiner* — Minh D A

(57) ABSTRACT

A drive circuit (1) for driving a load (3) comprises: a power supply (10) for supplying an output current ($I_L$); a controller (20) for controlling the power supply; a current sensor (25) for generating a current sense signal ($V_{25}$); a controllable switch (30) in series with the output (2*a*, 2*b*), the switch being controlled by a mode controller (50); wherein the mode controller in a reduced brightness mode generates its switch control signal ($S_{LC}$) for the switch for alternatively opening and closing the switch. At the end of a current pulse, an average current value averaged over the pulse duration is calculated, compared with a reference value ($V_{REF}$), and, if said average value is larger than the reference value, a duration for the next pulse pause is calculated such that an average value averaged over the entire pulse period is equal to the reference value.

9 Claims, 4 Drawing Sheets

DRIVE CIRCUIT FOR DRIVING A LOAD WITH PULSED CURRENT

FIELD OF THE INVENTION

The present invention relates in general to a drive circuit for driving a load with pulsed current. More particularly, the present invention relates to a drive circuit comprising a switched mode power supply. The invention more particularly relates to driving a LED array, but the principles of the present invention can also be applied to other types of load.

BACKGROUND OF THE INVENTION

LEDs are conventionally known as signalling devices, for instance an indicator that an apparatus is stand-by. With the development of high-power LEDs, LEDs are nowadays also used for illumination applications. In a particular application, a LED array is used in a tail light unit of a vehicle, specifically a motor vehicle. In such application, the LED array can have two different operational modes. In a first mode, the LEDs generate maximum light intensity. This is achieved by operating the LEDs continuously with nominal current (DC). In this mode, the LED array functions as brake light, so this mode is also referred to as "brake mode". This brake mode is only active for as long as the vehicle driver actuates the brake pedal or brake handle.

In a second mode, the LEDs generate reduced light intensity. In this mode, the LED array functions as tail light, so this mode is also referred to as "tail mode". Reducing the light intensity can be done by reducing the LED current. However, this is not preferred, because the color and efficiency of the LEDs may change if the current intensity changes. Therefore, reducing the light intensity is typically done by driving the LEDs with pulsed current, i.e. the current is alternatively zero or maximal (i.e. nominal). A time interval where the current is zero will be indicated as an OFF interval or pulse pause: during such interval, the LED is OFF. The duration of this interval will be indicated as OFF duration or pulse pause duration. A time interval where the current is nominal will be indicated as an ON interval or pulse: during such interval, the LED is ON. The duration of this interval will be indicated as ON duration or pulse duration. The average light intensity depends on the duty cycle, i.e. the ratio of the pulse duration (ON) to the duration of the pulse period (ON+OFF). A lamp driver is designed to keep the average light intensity constant by keeping the average current constant.

Driver circuits for driving an arrangement of LEDs with substantially constant current are already known. Typically, such constant current driver circuit comprises a current sensor for sensing the LED current, and a sensor signal is fed back to a controller, which controls a power source such that the sensed current is kept substantially constant at a predetermined level. The drive circuit further comprises a controllable switch connected in series with the lamp. In tail mode, the controller switches the switch OPEN and CLOSED alternatively. During the pulse intervals, the LED current is kept substantially at the nominal level; if current deviations occur, the influence on the average current is compensated by varying the duty cycle.

A problem may occur if the power source is a relatively slow power source. This problem typically may occur in case the power source is implemented as a converter, but the problem may also arise in the case of other types of power sources. In this respect, "slow" means that the time it takes for the power source to have its output current rise from zero to the nominal current level is longer than the pulse duration. During the pulse pause, the output current of the power source reduces, perhaps even drops back to zero, and at the start of the next pulse the current starts rising again. Thus, if the nominal level is reached at all, it may take many current periods until the LED current finally reaches this level, which means that the intensity of the tail lights reaches its operative level only very slowly.

The present invention aims to provide a drive circuit where this problem is overcome or at least reduced. More particularly, the present invention aims to provide a drive circuit which is capable of driving LEDs with pulsed current and which has improved start-up characteristics.

SUMMARY OF THE INVENTION

According to an important aspect of the invention, the driver circuit calculates the average current intensity during the current pulses. If the average current intensity is less than nominal, the driver circuit reduces the pulse pause duration of the next pulse pause. Ideally, it is thus possible to have the average current intensity (averaged over the entire current period) reach its target value relatively fast, even if the power supply is relatively slow.

BRIEF DESCRIPTION OF THE DRAWINGS

These and other aspects, features and advantages of the present invention will be further explained by the following description with reference to the drawings, in which same reference numerals indicate same or similar parts, and in which.

DETAILED DESCRIPTION OF THE INVENTION

Figure 1:
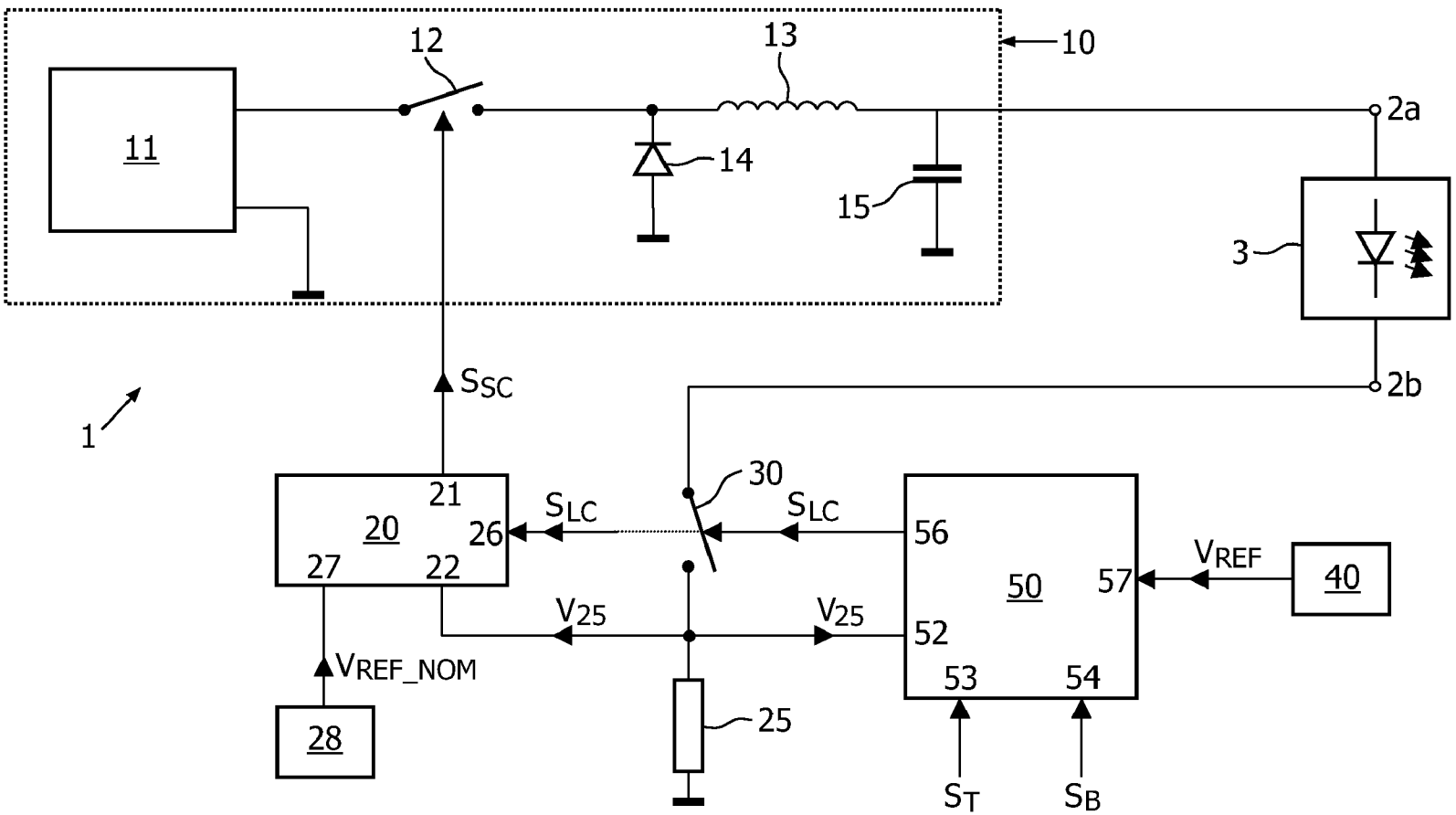
FIG. 1 is a block diagram schematically showing a driver circuit.

FIG. 1 is a block diagram schematically showing a driver circuit 1 having output terminals 2*a*, 2*b* for connection to a load 3. The driver circuit 1 further comprises a controllable switched mode power supply 10, and a supply controller 20 for controlling the power supply 10. It is noted that the principles of the invention can be applied to several types of load, but in the following it will be assumed that the load is a LED arrangement 3 comprising a plurality of LEDs arranged in series and/or in parallel, used as a rear light unit in a car.

Switched mode power supplies are known per se, therefore the description of the exemplary switched mode power supply 10 illustrated in FIG. 1 will be kept brief. Reference numeral 11 indicates a voltage source, such as a car battery. A controllable switch 12, for instance a transistor, is coupled to a first output terminal of the voltage source 11. An inductor 13, typically a coil, is coupled in series with the controllable switch 12. At the junction of the switch 12 and the inductor 13, a diode 14 is coupled to a second output terminal of the voltage source 11, while the opposite end of the inductor 13 is coupled to a first output terminal 2*a* of the driver circuit 1. A second output terminal 2*b* of the driver circuit 1 is coupled to the second output terminal of the voltage source 11. At the junction of the first output terminal 2*a* and the inductor 13, a capacitor 15 is coupled to the second output terminal of the voltage source 11.

The supply controller 20 has a control output 21 coupled to a control terminal of the switch 12, providing a supply control signal $S_{SC}$ determining the operative state of the switch 12, more specifically determining the switching moments of the switch 12. The supply control signal $S_{SC}$ is typically a block signal that is either HIGH or LOW. One value of the control output signal Sc, for instance HIGH, results in the switch 12 being closed (i.e. conductive): current flows from the voltage source 11 through the inductor 13 and the LED arrangement 3 back to the voltage source, while the current magnitude increases with time. The inductor 13 is being charged. The other value of the supply control signal $S_{SC}$, for instance LOW, results in the switch 12 being open (i.e. non-conductive). The inductor 13 tries to maintain the current, which now flows in the loop defined by the inductor 13, the LED arrangement 3 and the diode 14, while the current magnitude decreases with time. The inductor 13 is being discharged.

Figure 2:
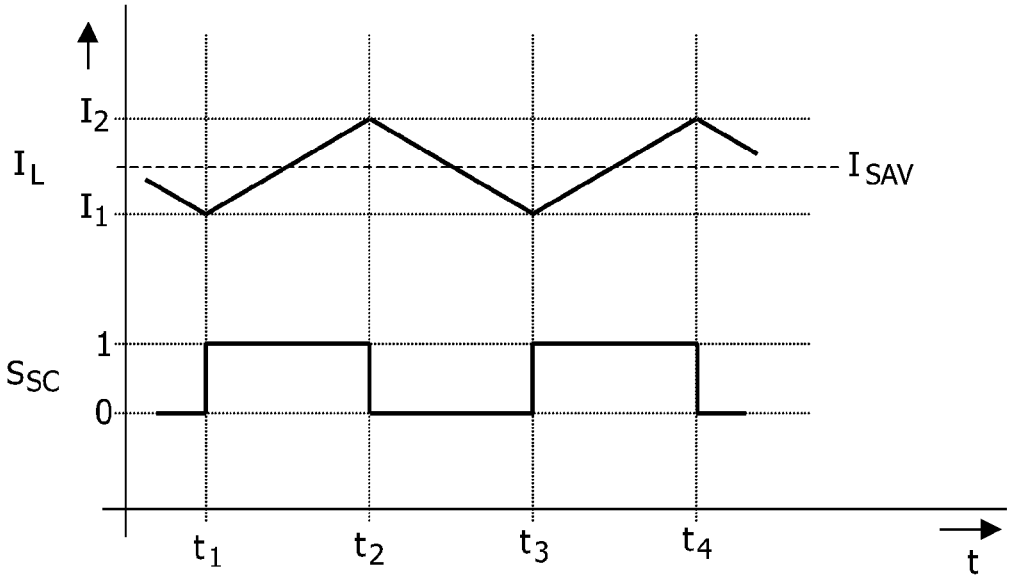
FIG. 2 is a graph illustrating the operation of a power source.

FIG. 2 is a graph illustrating this operation. At times $t_1$ and $t_3$, the supply control signal $S_{SC}$ becomes HIGH and the output current $I_L$ through the LEDs starts to rise. At times $t_2$ and $t_4$, the supply control signal $S_{SC}$ becomes LOW and the output current $I_L$ through the LEDs starts to decrease. At times $t_1$ and $t_3$, the output current $I_L$ has a minimum magnitude $I_1$, while at times $t_2$ and $t_4$, the output current $I_L$ has a maximum magnitude $I_2$. The short term average output current $I_{SAV}$ is a value midway between $I_1$ and $I_2$. By increasing/decreasing the duty cycle of the supply control signal $S_{SC}$, the short term average output current $I_{SAV}$ can be increased/decreased. In this respect, the phrase "short term average" is used to indicate an average over a signal period from $t_1$ to $t_3$.

The driver circuit 1 further comprises a current sensor 25, in the exemplary embodiment of FIG. 1 implemented as a resistor connected in series with the LED arrangement 3 between the second output terminal 2*b* and mass. The LED current $I_L$ results in a voltage drop $V_{25}$ over the current sense resistor 25 proportional to the LED current $I_L$. The voltage $V_{25}$ constitutes a current measuring signal, which is provided to the controller 20 at a current sense input 22. At a reference input 27, the supply controller 20 receives a reference signal $V_{REF\text{-}NOM}$ from a reference source 28, which reference signal $V_{REF\text{-}NOM}$ indicates the target value of the short term average current $I_{SAV}$. The controller 20 compares the current measuring signal $V_{25}$ with the reference signal $V_{REF\text{-}NOM}$. Based on this comparison, the controller 20 generates its supply control signal $S_{SC}$. If the current measuring signal $V_{25}$ indicates that the LED current $I_L$ is too high/low, the controller 20 will amend the timing of the supply control signal $S_{SC}$ such that the duty cycle is decreased/increased. The threshold voltage is set to such level that the resulting short term average current $I_{SAV}$ has a predetermined, nominal value $I_{NOM}$, adapted to the LEDs of the arrangement 3.

The circuit 1 is capable of selectively operating in one of at least two modes. A first mode will be indicated as full intensity mode. In this mode, the LED current is generated continuously, so that the LEDs continuously emit light at full intensity with a color meeting design specifications.

A second mode will be indicated as reduced brightness mode. In this mode, the LED current is generated intermittently, so that the LEDs are alternatively ON and OFF. During the ON periods, the short term average current $I_{SAV}$ has the nominal value $I_{NOM}$, and the light has the same intensity and color as during the full intensity mode. During the OFF periods, the lamp current is zero and the LEDs emit no light.

Figure 3:
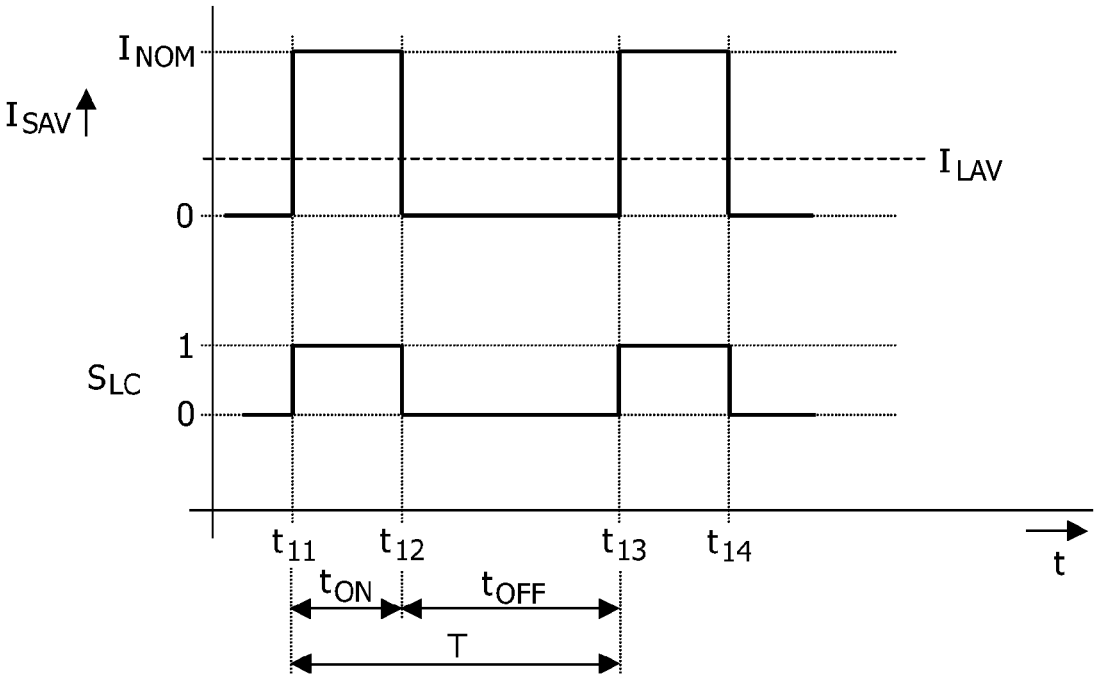
FIG. 3 is a graph illustrating the switching of the lamp current.

For being able to execute this reduced brightness mode, the driver circuit 1 further comprises a second controllable switch 30, for example a transistor, arranged in series with the LED arrangement 3 and the sense resistor 25, and controlled by a mode controller 50. This second controllable switch 30 will also be indicated as lamp switch. The mode controller 50 has a control output 56, coupled to a control input of the lamp switch 30, for providing a lamp switch control signal $S_{LC}$. FIG. 3 is a graph, comparable to FIG. 2 but at a larger time scale, illustrating this mode of operation. The Fig. shows that the lamp switch control signal $S_{LC}$ can have two values, indicated as 1 and 0 or HIGH and LOW. Between times $t_{11}$ and $t_{12}$, the lamp switch control signal $S_{LC}$ is HIGH, resulting in the switch 30 being closed (conductive). Between times $t_{12}$ and $t_{13}$, the lamp switch control signal $S_{LC}$ is LOW, resulting in the switch 30 being open (non-conductive). The upper half of this graph illustrates the resulting current shape; more particularly, the graph shows the short term average current $I_{SAV}$ as a function of time. During an ON period, i.e. from time $t_{11}$ to $t_{12}$, the short term average current $I_{SAV}$ has the nominal value $I_{NOM}$, whereas during an OFF period, i.e. from time $t_{12}$ to $t_{13}$, the short term average current $I_{SAV}$ is zero. The ON period will also be indicated as pulse, having a pulse duration $t_{ON}$ equal to $(t_{12}-t_{11})$. The OFF period will also be indicated as pulse pause, having a pause duration $t_{OFF}$ equal to $(t_{13}-t_{12})$. The combination of pulse and pause defines the current period, having a duration T equal to $(t_{13}-t_{11})$. A duty cycle $\Delta$ is defined as $\Delta=t_{ON}/T$.

A long term average current $I_{LAV}$ is defined as the average of the short term average current $I_{SAV}$ over the current period. It should be clear that the long term average current $I_{LAV}$ relates to the short term average current $I_{SAV}$ according to the following formula:

$$I_{LAV}=\Delta\cdot I_{SAV}$$

Similarly, the brightness (average light intensity) of the light output of the LED arrangement 3 is reduced, for which reason this mode is indicated as reduced brightness mode.

The mode controller 50 has two mode selection inputs 53 and 54, receiving two mode selection signals $S_T$ and $S_B$, respectively. Each mode selection signal can have one of two values, indicated as HIGH and LOW. The controller 50 is responsive to the mode selection signals $S_T$ and $S_B$ to select its operative mode, as follows. If both signals are LOW, the controller is in an OFF mode; the lamp switch control signal $S_{LC}$ is continuously LOW, the lamp current is continuously zero, the LEDs are continuously OFF. If the second mode selection signal $S_B$ is ON, irrespective of the value of the first mode selection signal $S_T$, the mode controller 50 operates in its full intensity mode. If the second mode selection signal $S_B$ is OFF and the first mode selection signal $S_T$ is ON, the mode controller 50 operates in its reduced brightness mode. Thus, the system is suitable for operation as rear light unit in a car, where the first mode selection signal $S_T$ is provided by the light switch while the second mode selection signal $S_B$ is provided by the brake pedal.

Figure 4A:
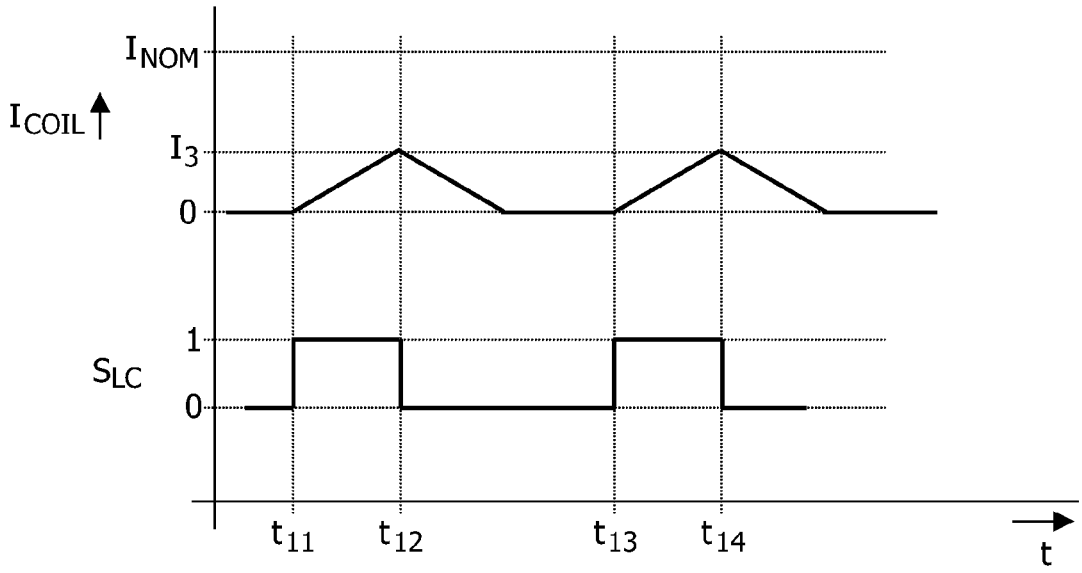
FIGS. 4A and 4B are graphs illustrating a current in the power source as a function of time.

The operation of the driver described above with reference to FIG. 3 is the desired operation. It is implemented relatively easily if the power supply 10 is a fast source: in that case, opening the switch 30 will immediately interrupt the current path from the supply 10 to the LEDs 3 and a current flow is inhibited, while closing the switch will immediately enable the current flow again. However, a problem occurs if the power supply 10 is a slow source. In the context of the present invention, a power supply will be indicated as being "slow" in case it is not capable of having its output current rise from zero to nominal current $I_{NOM}$ within one pulse duration. This situation is illustrated in FIG. 4A, which is a graph having a time scale comparable to FIG. 3. During a pulse from time $t_{11}$ to time $t_{12}$, the current increases, with an increase rate comparable to the increase rate illustrated in FIG. 2 from time $t_1$ to time $t_2$. During a pause from time $t_{12}$ to time $t_{13}$, the current decreases, with a decrease rate comparable to the decrease rate illustrated in FIG. 2 from time $t_2$ to time $t_3$. At time $t_{13}$, the current starts increasing again, but the current in inductor 13 may have reached zero before time $t_{13}$. The above process is repeated for each current pulse, with the lamp current only reaching a value $I_3$ much lower than $I_{NOM}$. In this manner, the lamp current never reaches the desired value $I_{NOM}$, and consequently the long term average $I_{LAV}$ never reaches its target value.

Figure 4B:
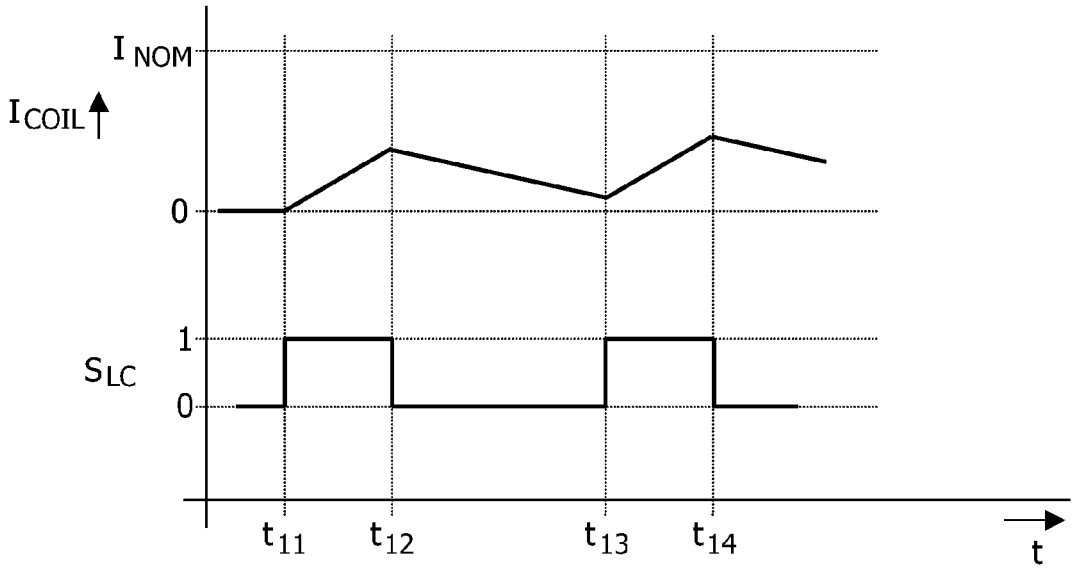

In a situation where the decrease rate is less than the increase rate, illustrated in FIG. 4B, the decreasing current is still above zero at time t13 when the next pulse begins. Then, after each pulse, the current has increased somewhat with respect to the previous pulse, and slowly the LED current is crawling towards the nominal current $I_{NOM}$. Likewise, the long term average $I_{LAV}$ is slowly crawling towards its target value. It may take several pulse periods before finally the long term average $I_{LAV}$ has reached its target value.

The present invention is aiming at reducing the above problem of a slow power supply. According to a first aspect of the present invention, the current decrease rate is reduced. This is done by making the converter 10 inactive. To this end, the supply controller 20 has a disable input 26 also receiving the switch control signal $S_{LC}$ from the mode controller 50. If the switch control signal $S_{LC}$ is HIGH, the converter 10 is active, as explained above. If the switch control signal $S_{LC}$ is LOW, the converter 10 is inactive, i.e. the supply controller 20 makes its supply control signal $S_{SC}$ continuously LOW, so that switch 12 is not switching any more. As a result, the condition of the converter 10 is "frozen" at the beginning of a pause ($t_{12}$, $t_{14}$, etc), its energy being stored in the capacitor 15.

Figure 5:
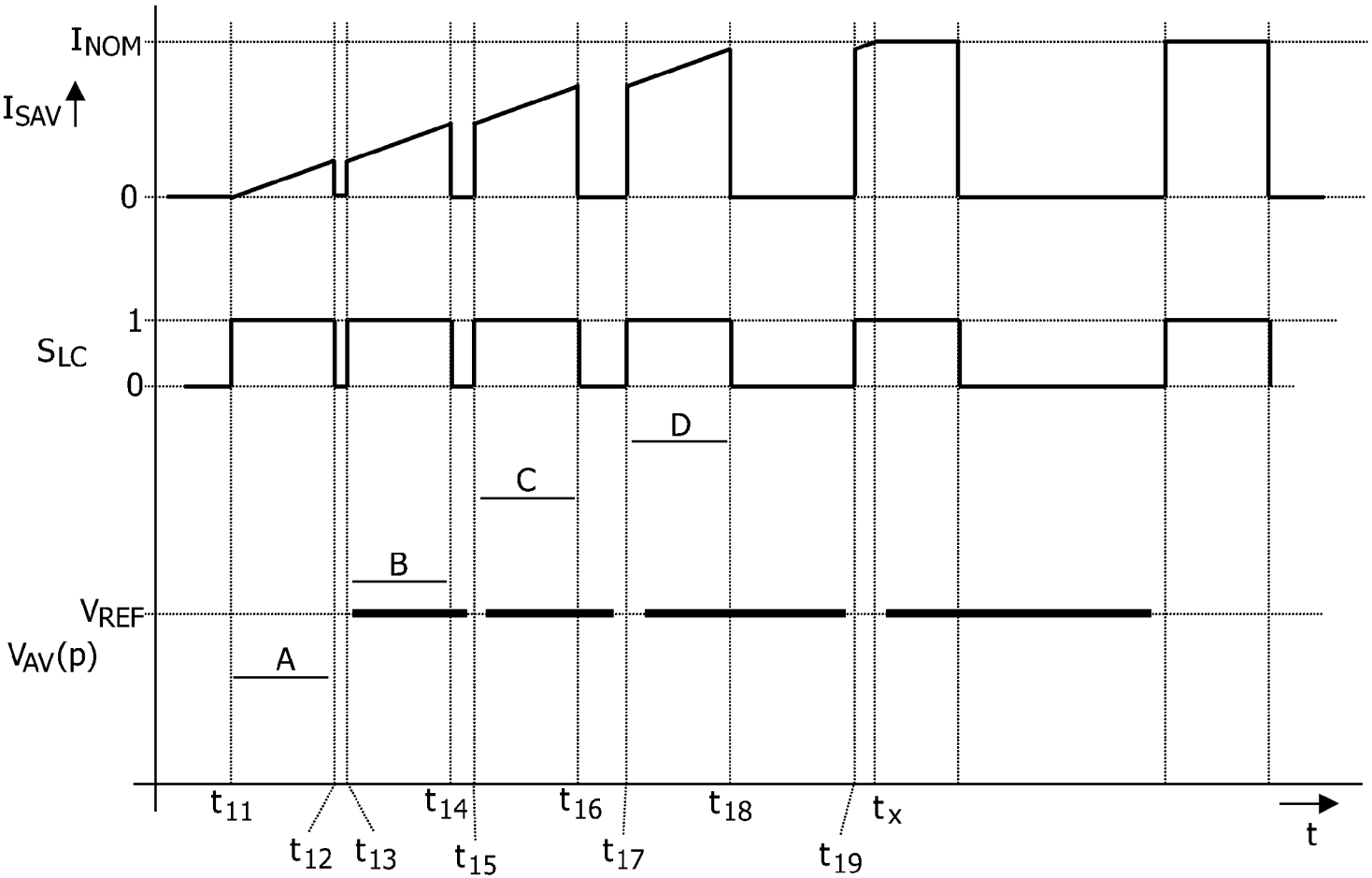
FIG. 5 is a graph illustrating the effect of the invention.

The fact that the converter 10 hardly looses its energy during the pulse pause has an important advantage. During the pulse pause, the output current is of course zero, but the converter 10 maintains a current potential so that, at the start of a next current pulse, it is capable of providing almost the same current intensity as at the end of the previous current pulse, as illustrated in FIG. 5. With each current pulse, the current starts increasing as from the magnitude at the end of the previous pulse, until, after a few pulses, the nominal current magnitude $I_{NOM}$ has been reached.

According to a second aspect of the present invention, also illustrated in FIG. 5, the mode controller 50 takes the current sense signal $V_{25}$, received at a sense input 52, and calculates a pulse average value $V_{AV}(p)$ over the pulse duration (from $t_{11}$ to $t_{12}$). At a reference input 57, the mode controller 50 receives a reference signal $V_{REF}$ from a reference source 40, which reference signal $V_{REF}$ indicates the target value of the long term average current $I_{LAV}$. If at the end of a pulse, i.e. on time $t_{12}$, it appears that the pulse average value $V_{AV}(p)$, indicated by line segment A, is lower than the reference signal $V_{REF}$, the mode controller 50 starts a new pulse as soon as possible (i.e. the pulse pause duration $t_{13}-t_{12}$ is as small as possible). It may be that the mode controller 50 is capable of making the pulse pause duration to be virtually equal to zero. It may also be that the pulse pause duration at least has a certain minimum duration.

If at the end of a pulse, i.e. on time $t_{14}$, $t_{16}$, $t_{18}$, it appears that the pulse average value $V_{AV}(p)$, indicated by line segments B, C, D, is above $V_{REF}$, the controller 20 calculates a pause duration ($t_{15}-t_{14}$), ($t_{17}-t_{16}$), ($t_{19}-t_{18}$), such that the current average over the entire period, indicated by the thick line segments, is equal to $V_{REF}$. The pause duration $t_{PAUSE}$ can be calculated according to $$t_{PAUSE} = \frac{V_{AV}(p) - V_{REF}}{V_{REF}} \cdot t_{PULSE}$$

wherein $t_{PULSE}$ indicates the pulse duration.

Thus, while it can be seen in FIG. 5 that the lamp current $I_{SAV}$ during the pulses is slowly rising until finally reaching the nominal value $I_{NOM}$ at time $t_X$, the pulse pauses are increasing in length such that the average lamp current $I_{LAV}$, averaged over the entire period, is already at the target value after the second pulse, on time $t_{14}$.

It is noted that the mode controller 50 preferably sets the pause duration $t_{PAUSE}$ to be equal to the value calculated by the above formula. However, depending on the system, it may be that the mode controller 50 is only capable of setting the pause duration $t_{PAUSE}$ to be equal to certain predetermined discrete values. In that case, the mode controller 50 will select a discrete value as close to the calculated value as possible. In any case, the mode controller 50 will increase the pause duration during the start up procedure, with the effect that, at the beginning of the start up procedure, when the actual current is still below the nominal current, the long term average already reaches the target value relatively early.

It should be clear to a person skilled in the art that the present invention is not limited to the exemplary embodiments discussed above, but that several variations and modifications are possible within the protective scope of the invention as defined in the appending claims.

For instance, in the illustrative embodiment of FIG. 1, the two controllers 20 and 50 have been described as separate controllers. It is however, also possible that these two controllers are integrated. Further, instead of receiving the switch control signal $S_{LC}$ at its enable/disable input 26, it is possible that the supply controller 20 receives different signal which has a timing slightly differing from the timing of the switch control signal $S_{LC}$, allowing the supply controller 20 to switch slightly earlier or slightly later than the switch 30, as desired.

Further, in the above the invention has been described for an embodiment where the pulse duration was kept constant and the pause duration was adapted; as a result, the pulse frequency will change. It is, however, also possible to achieve duty cycle variation in another way, for instance by keeping the pause duration constant and adapting the pulse duration, or by varying both durations such that the frequency is kept constant.

Further, in the above the invention has been described for an embodiment where the supply controller 20 is discussed as being external of the supply 10. It is, however, also possible that the supply controller 20 is integrated in the supply, in which case the supply can be seen as a black box with an enable/disable input 26.

In the above, the present invention has been explained with reference to block diagrams, which illustrate functional blocks of the device according to the present invention. It is to be understood that one or more of these functional blocks may be implemented in hardware, where the function of such functional block is performed by individual hardware components, but it is also possible that one or more of these functional blocks are implemented in software, so that the function of such functional block is performed by one or more program lines of a computer program or a programmable device such as a microprocessor, microcontroller, digital signal processor, etc.

The invention claimed is:

1. A drive circuit for driving a load, the circuit comprising:

(i) an output for connecting the load;

(ii) a power supply for supplying an output current at the output (IL);

(iii) a current sensor for generating a current sense signal ($V_{25}$) representing the output current (IL);

(iv) a supply controller for controlling the power supply, the supply controller having a current sense input for receiving the current sense signal ($V_{25}$); wherein the supply controller has a supply control output coupled to the power supply, the supply controller being configured to generate a supply control signal (Ssc) for the power supply;

(v) a reference source for generating a reference value (VREF-NOM); wherein the supply controller has a reference input for receiving the reference value (VREF-NOM), the supply controller being configured to compare the received current sense signal ($V_{25}$) with the reference value (VREF-NOM), and, based on comparison, to generate its supply control signal (Ssc) for adjusting the output current (IL) accordingly;

(vi) a controllable switch in series with the output;

(vii) a mode controller for controlling the controllable switch, the mode controller having a current sense input for receiving the current sense signal ($V_{25}$), the mode controller having a switch control output coupled to a control input of the switch, the mode controller being configured to generate a switch control signal (SLC) for the switch based on the received current sense signal ($V_{25}$); wherein the mode controller is capable of operating in a reduced brightness mode, in which the mode controller generates the switch control signal (SLC) for the switch for alternatively opening and closing the switch to define current pulses and pulse pauses; wherein the supply controller has a disable input for receiving a disable signal having a timing equal to or slightly differing from the timing of the switch control signal (SLC), and wherein the supply controller is configured, responsive to the disable signal, to activate or inactivate the power supply.

2. The drive circuit according to claim 1, wherein the mode controller is configured, on start up, to generate the switch control signal (SLC) with a relatively high duty cycle and to gradually decrease the duty cycle over time.

3. The drive circuit according to claim 1, wherein the mode controller is configured, at an end of a current pulse, to calculate, base on the received current sense signal ($V_{25}$), an average value averaged over a pulse duration, to compare this average value with a reference value (VREF), and, depending on the outcome of the comparison, to calculate a duration for a next pulse pause.

4. The drive circuit according to claim 3, wherein the mode controller is configured, if said average value is larger than said reference value (VREF), to calculate the duration for the next pulse pause such that an average value over an entire pulse period is equal to the reference value (VREF).

5. The drive circuit according to claim 3, wherein the mode controller is configured, if said average value is lower than the reference value (VREF), to set the duration for the next pulse pause to a relatively low value.

6. The drive circuit according to claim 3, wherein the pulse duration is constant.

7. The drive circuit according to claim 1, wherein the mode controller comprises at least a first mode selection input for receiving a first mode selection signal (ST), and wherein the mode controller is selectively operating in said reduced brightness mode in response to the first mode selection signal (ST).

8. The drive circuit according to claim 7, wherein the mode controller further comprises a second mode selection input for receiving a second mode selection signal (SB), and wherein the mode controller is selectively operating in said reduced brightness mode in response to the first mode selection signal (ST) having a first predetermined value (ON) and the second mode selection signal (SB) having a second predetermined value (OFF).

9. The drive circuit according to claim 8, wherein the mode controller is further capable of operating in a full intensity mode, in which the mode controller generates its switch control signal (SLC) for the switch for continuously keeping the switch closed (conductive); and wherein the mode controller is selectively operating in said full intensity mode in response to the second mode selection signal (SB) having a predetermined value (ON) differing from said second predetermined value (OFF), irrespective of the value of the first mode selection signal (ST).

* * * * *